US012234525B2

(12) United States Patent
Endo et al.

(10) Patent No.: US 12,234,525 B2
(45) Date of Patent: Feb. 25, 2025

(54) MARTENSITIC STAINLESS STEEL SEAMLESS PIPE FOR OIL COUNTRY TUBULAR GOODS, AND METHOD FOR MANUFACTURING SAME

(71) Applicant: JFE STEEL CORPORATION, Tokyo (JP)

(72) Inventors: Mami Endo, Tokyo (JP); Yuichi Kamo, Tokyo (JP); Masao Yuga, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 766 days.

(21) Appl. No.: 17/291,150

(22) PCT Filed: Sep. 25, 2019

(86) PCT No.: PCT/JP2019/037691
§ 371 (c)(1),
(2) Date: May 4, 2021

(87) PCT Pub. No.: WO2020/095559
PCT Pub. Date: May 14, 2020

(65) Prior Publication Data

US 2022/0074009 A1 Mar. 10, 2022

(30) Foreign Application Priority Data

Nov. 5, 2018 (JP) ..... 2018-207831

(51) Int. Cl.

| | |
|---|---|
| ***C21D 9/08*** | (2006.01) |
| ***C21D 1/18*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C21D 9/085* (2013.01); *C21D 1/18* (2013.01); *C21D 6/004* (2013.01); *C21D 6/005* (2013.01); *C21D 6/007* (2013.01); *C21D 6/008* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01)

(58) Field of Classification Search
CPC ..... C21D 2211/008
See application file for complete search history.

(56) References Cited

U.S. PATENT DOCUMENTS

| | | | |
|---|---|---|---|
| 2003/0217789 | A1 | 11/2003 | Yoshizawa et al. |
| 2008/0073005 | A1 | 3/2008 | Buck |
| 2009/0017238 | A1 | 1/2009 | Miyata et al. |
| 2017/0029912 | A1 | 2/2017 | De Carvalho et al. |
| 2019/0177823 | A1* | 6/2019 | Matsuo ..... C22C 38/54 |

FOREIGN PATENT DOCUMENTS

| | | | |
|---|---|---|---|
| CN | 1571859 | A | 1/2005 |
| CN | 1816639 | A | 8/2006 |
| CN | 101171351 | A | 4/2008 |
| CN | 102534419 | A | 7/2012 |
| CN | 104411852 | A | 3/2015 |
| CN | 105039863 | A | 11/2015 |
| CN | 106414785 | A | 2/2017 |
| CN | 106661683 | A | 5/2017 |
| CN | 108277438 | A | 7/2018 |
| EP | 1 652 950 | A1 | 5/2006 |
| EP | 2 865 777 | A1 | 4/2015 |
| EP | 3 121 306 | A1 | 1/2017 |

(Continued)

OTHER PUBLICATIONS

Oct. 19, 2022 Office Action issued in Chinese Patent Application No. 201980072666.9.
Aug. 10, 2022 Office Action issued in U.S. Appl. No. 17/059,078.
Jul. 15, 2022 Office Action issued in Chinese Patent Application No. 201980072666.9.
Apr. 19, 2022 Office Action issued in Chinese Patent Application No. 201980072666.9.

(Continued)

*Primary Examiner* — Nicholas A Wang
(74) *Attorney, Agent, or Firm* — Oliff PLC

(57) ABSTRACT

The disclosure is intended to provide a martensitic stainless steel seamless pipe for oil country tubular goods having high strength and excellent sulfide stress corrosion cracking resistance and a method for manufacturing thereof. The martensitic stainless steel seamless pipe for oil country tubular goods has a composition that contains, in mass %, C: 0.0100% or more, Si: 0.5% or less, Mn: 0.25 to 0.50%, P: 0.030% or less, S: 0.005% or less, Ni: 4.6 to 8.0%, Cr: 10.0 to 14.0%, Mo: 1.0 to 2.7%, Al: 0.1% or less, V: 0.005 to 0.2%, N: 0.1% or less, Ti: 0.06 to 0.25%, Cu: 0.01 to 1.0%, and Co: 0.01 to 1.0%, in which C, Mn, Cr, Cu, Ni, Mo, W, Nb, N, and Ti satisfy predetermined relations, and the balance is Fe and incidental impurities. The martensitic stainless steel seamless pipe has a yield stress of 758 MPa or more.

4 Claims, No Drawings

(56) References Cited

FOREIGN PATENT DOCUMENTS

| | | | | |
|---|---|---|---|---|
| EP | 3 246 418 | A1 | | 11/2017 |
| EP | 3 460 087 | A1 | | 3/2019 |
| JP | 863210234 | A | | 8/1988 |
| JP | 2000-160300 | A | | 6/2000 |
| JP | 2001-032047 | A | | 2/2001 |
| JP | 2006110585 | A | | 4/2006 |
| JP | 2010-242163 | A | | 10/2010 |
| JP | WO2014203472 | | * | 12/2014 |
| JP | 2015161010 | | * | 9/2015 |
| JP | WO2017168874 | | * | 10/2017 |
| WO | 2004/057050 | A1 | | 7/2004 |
| WO | 2008/023702 | A1 | | 2/2008 |
| WO | 2014/203472 | A1 | | 12/2014 |
| WO | 2017/168874 | A1 | | 10/2017 |
| WO | 2017/200083 | A1 | | 11/2017 |
| WO | 2018/079111 | A1 | | 5/2018 |
| WO | 2018/181404 | A1 | | 10/2018 |

OTHER PUBLICATIONS

Dec. 17, 2019 Search Report issued in International Patent Application No. PCT/JP2019/037691.

Oct. 26, 2023 Office Action issued in U.S. Appl. No. 17/058,781.

Nov. 3, 2021 Extended European Search Report issued in European Patent Application No. 19881910.4.

Nov. 24, 2021 Office Action issued in Chinese Patent Application No. 201980072666.9.

Nov. 29, 2021 Office Action issued in U.S. Appl. No. 16/646,347.

Mar. 30, 2022 Office Action issued in U.S. Appl. No. 16/646,347.

Sep. 8, 2022 Office Action issued in U.S. Appl. No. 16/646,347.

Dec. 12, 2022 Office Action issued in U.S. Appl. No. 16/646,347.

Jan. 26, 2023 Office Action issued in U.S. Appl. No. 16/646,347.

Aug. 16, 2024 Office Action issued in U.S. Appl. No. 17/058,781.

* cited by examiner

MARTENSITIC STAINLESS STEEL SEAMLESS PIPE FOR OIL COUNTRY TUBULAR GOODS, AND METHOD FOR MANUFACTURING SAME

TECHNICAL FIELD

This application relates to a martensitic stainless steel seamless pipe for oil country tubular goods for use in crude oil well and natural gas well applications (hereinafter, referred to simply as "oil well"), and to a method for manufacturing such a martensitic stainless steel seamless pipe. Particularly, the application relates to a seamless pipe for oil country tubular goods having a yield stress YS of 758 MPa or more, and excellent sulfide stress corrosion cracking resistance (SSC resistance) in a hydrogen sulfide ($H_2S$)-containing environment, and to a method for manufacturing such a martensitic stainless steel seamless pipe for oil country tubular goods.

BACKGROUND

Increasing crude oil prices and an expected shortage of petroleum resources in the near future have prompted active development of oil fields and gas fields that were unthinkable in the past, for example, such as deep oil fields, and oil fields and gas oil fields of severe corrosive environments containing carbon dioxide gas, chlorine ions, and hydrogen sulfide. The material of steel pipes for oil country tubular goods for use in these environments requires high strength, and excellent corrosion resistance.

Oil country tubular goods used for mining of oil fields and gas fields of an environment containing carbon dioxide gas, chlorine ions, and the like typically use 13% Cr martensitic stainless steel pipes. There has also been global development of oil fields in very severe corrosive environments containing hydrogen sulfide. Accordingly, the need for SSC resistance is high, and there has been increasing use of an improved 13% Cr martensitic stainless steel pipe of a reduced C content and increased Ni and Mo contents.

PTL 1 describes a 13% Cr-base martensitic stainless steel pipe of a composition containing carbon in an ultra low content of 0.015% or less, and 0.03% or more of Ti. It is stated in PTL 1 that this stainless steel pipe has high strength with a yield stress on the order of 95 ksi, low hardness with an HRC of less than 27, and excellent SSC resistance. PTL 2 describes a martensitic stainless steel that satisfies $6.0 \leq Ti/C \leq 10.1$, where Ti/C has a correlation with a value obtained by subtracting a yield stress from a tensile stress. It is stated in PTL 2 that this technique, with a value obtained by subtracting a yield stress from a tensile strength being 20.7 MPa or more, can reduce hardness variation that impairs SSC resistance.

PTL 3 describes a martensitic stainless steel containing Mo in a limited content of $Mo \geq 2.3-0.89Si+32.2C$, and having a metal microstructure composed mainly of tempered martensite, carbides that have precipitated during tempering, and intermetallic compounds such as a Laves phase and a δ phase formed as fine precipitates during tempering. It is stated in PTL 3 that the steel produced by this technique achieves high strength with a 0.2% proof stress of 860 MPa or more, and has excellent carbon dioxide corrosion resistance and sulfide stress corrosion cracking resistance.

CITATION LIST

Patent Literature

PTL 1: JP-A-2010-242163
PTL 2: WO2008/023702
PTL 3: WO2004/057050

SUMMARY

Technical Problem

The development of recent oil fields and gas fields is made in severe corrosive environments containing $CO_2$, $Cl^-$, and $H_2S$. Increasing $H_2S$ concentrations due to aging of oil fields and gas fields are also of concern. Steel pipes for oil country tubular goods for use in these environments are therefore required to have excellent sulfide stress corrosion cracking resistance.

PTL 1 states that sulfide stress corrosion cracking resistance can be maintained under an applied stress of 655 MPa in an atmosphere of a 5% NaCl aqueous solution ($H_2S$: 0.10 bar) having an adjusted pH of 3.5. The steel described in PTL 2 has sulfide stress corrosion cracking resistance in an atmosphere of a 20% NaCl aqueous solution ($H_2S$: 0.03 bar, $CO_2$ bal.) having an adjusted pH of 4.5. The steel described in PTL 3 has sulfide stress corrosion cracking resistance in an atmosphere of a 25% NaCl aqueous solution ($H_2S$: 0.03 bar, $CO_2$ bal.) having an adjusted pH of 4.0. However, these patent applications do not take into account sulfide stress corrosion cracking resistance in atmospheres other than those described above and it cannot be said that the steels described in these patent applications have the level of sulfide stress corrosion cracking resistance that can withstand the today's ever demanding severe corrosive environments.

It is accordingly an object of the present application to provide a martensitic stainless steel seamless pipe for oil country tubular goods having a yield stress of 758 MPa (110 ksi) or more, and excellent sulfide stress corrosion cracking resistance. The application is also intended to provide a method for manufacturing such a martensitic stainless steel seamless pipe.

As used herein, "excellent sulfide stress corrosion cracking resistance" means that a test piece dipped in a test solution (a 0.165 mass % NaCl aqueous solution; liquid temperature: 25° C.; $H_2S$: 1 bar; $CO_2$ bal.) having an adjusted pH of 3.5 with addition of sodium acetate and hydrochloric acid does not crack even after 720 hours under an applied stress equal to 90% of the yield stress.

Solution to Problem

In order to achieve the foregoing objects, the present inventors conducted intensive studies of the effects of various alloy elements on sulfide stress corrosion cracking resistance (SSC resistance) in a $CO_2$-, $Cl^-$-, and $H_2S$-containing corrosive environment, using a 13% Cr-base stainless steel pipe as a basic composition. The studies found that a martensitic stainless steel seamless pipe for oil country tubular goods having the desired strength, and excellent SSC resistance in a $CO_2$-, $Cl^-$-, and $H_2S$-containing corrosive environment, and in an environment under an applied stress close to the yield stress can be provided when the steel has a composition in which the steel components are contained in predetermined ranges, and in which C, Mn, Cr, Cu, Ni, Mo, N, and Ti, and optionally, W and Nb, are contained in adjusted amounts that satisfy the appropriate relations and ranges, and when the steel is subjected to appropriate quenching and tempering.

The present application is based on this finding, and was completed after further studies. Specifically, the disclosed embodiments are as follows.

[1] A martensitic stainless steel seamless pipe for oil country tubular goods having a composition comprising, in mass %, C: 0.0100% or more, Si: 0.5% or less, Mn: 0.25 to 0.50%, P: 0.030% or less, S: 0.005% or less, Ni: 4.6 to 8.0%, Cr: 10.0 to 14.0%, Mo: 1.0 to 2.7%, Al: 0.1% or less, V: 0.005 to 0.2%, N: 0.1% or less, Ti: 0.06 to 0.25%, Cu: 0.01 to 1.0%, Co: 0.01 to 1.0%, and the balance Fe and incidental impurities, the composition satisfying all of the relations in the formula (4) below with values of the following formulae (1), (2), and (3), and also satisfying the formula (5) or (6) below, the martensitic stainless steel seamless pipe having a yield stress of 758 MPa or more.

$$-109.37C+7.307Mn+6.399Cr+6.329Cu+11.343Ni-13.529Mo+1.276W+2.925Nb+196.775N-2.621Ti-120.307 \quad \text{Formula (1)}$$

$$-0.0278Mn+0.0892Cr+0.00567Ni+0.153Mo-0.0219W-1.984N+0.208Ti-1.83 \quad \text{Formula (2)}$$

$$-1.324C+0.0533Mn+0.0268Cr+0.0893Cu+0.00526Ni+0.0222Mo-0.0132W-0.473N-0.5Ti-0.514 \quad \text{Formula (3)}$$

$$-35.0 \leq \text{value of (1)} \leq 45.0,\ -0.600 \leq \text{value of (2)} \leq -0.250,\ \text{and}\ -0.400 \leq \text{value of (3)} \leq 0.010 \quad \text{Formula (4)}$$

$$Ti < 6.0C \quad \text{Formula (5)}$$

$$10.1C < Ti \quad \text{Formula (6)}$$

In the formulae, C, Mn, Cr, Cu, Ni, Mo, W, Nb, N, and Ti represent the content of each element in mass %, and the content is 0 (zero) percent for elements that are not contained.

[2] The martensitic stainless steel seamless pipe for oil country tubular goods according to item [1], wherein the composition further comprises, in mass %, one or two selected from Nb: 0.1% or less, and W: 1.0% or less.

[3] The martensitic stainless steel seamless pipe for oil country tubular goods according to item [1] or [2], wherein the composition further comprises, in mass %, one or two or more selected from Ca: 0.010% or less, REM: 0.010% or less, Mg: 0.010% or less, and B: 0.010% or less.

[4] A method for manufacturing a martensitic stainless steel seamless pipe for oil country tubular goods, the method comprising:

forming a steel pipe from a steel pipe material of the composition of any one of items [1] to [3];

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

Advantageous Effects

The present application has enabled production of a martensitic stainless steel seamless pipe for oil country tubular goods having excellent sulfide stress corrosion cracking resistance (SSC resistance) in a $CO_2$-, $Cl^-$-, and $H_2S$-containing corrosive environment, and high strength with a yield stress YS of 758 MPa (110 ksi) or more.

DETAILED DESCRIPTION

A martensitic stainless steel seamless pipe for oil country tubular goods of the present application contains, in mass %, C: 0.0100% or more, Si: 0.5% or less, Mn: 0.25 to 0.50%, P: 0.030% or less, S: 0.005% or less, Ni: 4.6 to 8.0%, Cr: 10.0 to 14.0%, Mo: 1.0 to 2.7%, Al: 0.1% or less, V: 0.005 to 0.2%, N: 0.1% or less, Ti: 0.06 to 0.25%, Cu: 0.01 to 1.0%, Co: 0.01 to 1.0%, and the balance Fe and incidental impurities, the composition satisfying all of the relations in the formula (4) below with values of the following formulae (1), (2), and (3), and also satisfying the formula (5) or (6) below, the martensitic stainless steel seamless pipe having a yield stress of 758 MPa or more.

$$-109.37C+7.307Mn+6.399Cr+6.329Cu+11.343Ni-13.529Mo+1.276W+2.925Nb+196.775N-2.621Ti-120.307 \quad \text{Formula (1)}$$

$$-0.0278Mn+0.0892Cr+0.00567Ni+0.153Mo-0.0219W-1.984N+0.208Ti-1.83 \quad \text{Formula (2)}$$

$$-1.324C+0.0533Mn+0.0268Cr+0.0893Cu+0.00526Ni+0.0222Mo-0.0132W-0.473N-0.5Ti-0.514 \quad \text{Formula (3)}$$

$$-35.0 \leq \text{value of (1)} \leq 545.0,\ -0.600 \leq \text{value of (2)} \leq -0.250,\ \text{and}\ -0.400 \leq \text{value of (3)} \leq 0.010 \quad \text{Formula (4)}$$

$$Ti < 6.0C \quad \text{Formula (5)}$$

$$10.1C < Ti \quad \text{Formula (6)}$$

In the formulae, C, Mn, Cr, Cu, Ni, Mo, W, Nb, N, and Ti represent the content of each element in mass %, and the content is 0 (zero) percent for elements that are not contained.

The following describes the reasons for specifying the composition of a steel pipe of the disclosed embodiments. In the following, "%" means percent by mass, unless otherwise specifically stated.

C: 0.0100% or More

C is an important element involved in the strength of the martensitic stainless steel, and is effective at improving strength. C is also an element that contributes to improving corrosion resistance, and improves the sulfide stress corrosion cracking resistance. For these reasons, the C content is limited to 0.0100% or more in the disclosed embodiments. However, when C is contained in excess amounts, the hardness increases, and the steel becomes more susceptible to sulfide stress corrosion cracking. For this reason, carbon is contained in an amount of preferably 0.0400% or less. That is, the preferred C content is 0.0100 to 0.0400%. The C content is more preferably 0.0100 to 0.0300%, further preferably 0.0100 to 0.0200%.

Si: 0.5% or Less

Si acts as a deoxidizing agent, and is contained in an amount of preferably 0.05% or more. A Si content of more than 0.5% impairs carbon dioxide corrosion resistance and hot workability.

For this reason, the Si content is limited to 0.5% or less. From the viewpoint of stably providing strength, the Si content is preferably 0.10% or more. The Si content is preferably 0.30% or less. More preferably, the Si content is 0.25% or less.

Mn: 0.25 to 0.50%

Mn is an element that improves strength. By contributing to repassivation, Mn improves the sulfide stress corrosion cracking resistance. Because Mn is an austenite forming element, Mn reduces formation of delta ferrite, which causes cracking or defect during pipe manufacture. A Mn content of 0.25% or more is needed to obtain these effects. When added in excess amounts, Mn precipitates into MnS, and impairs the sulfide stress corrosion cracking resistance. For this reason, the Mn content is limited to 0.25 to 0.50%. Preferably, the Mn content is 0.40% or less.

P: 0.030% or Less

P is an element that impairs carbon dioxide corrosion resistance, pitting corrosion resistance, and sulfide stress corrosion cracking resistance, and should desirably be contained in as small an amount as possible in the disclosed embodiments. However, an excessively small P content increases the manufacturing cost. For this reason, the P content is limited to 0.030% or less, which is a content range that does not cause a severe impairment of characteristics, and that is economically practical in industrial applications. Preferably, the P content is 0.015% or less.

S: 0.005% or Less

S is an element that seriously impairs hot workability, and should desirably be contained in as small an amount as possible. A reduced S content of 0.005% or less enables pipe production using an ordinary process, and the S content is limited to 0.005% or less in the disclosed embodiments. Preferably, the S content is 0.002% or less.

Ni: 4.6 to 8.0%

Ni strengthens the protective coating, and improves the corrosion resistance. That is, Ni contributes to improving the sulfide stress corrosion cracking resistance. Ni also increases steel strength by forming a solid solution. Ni needs to be contained in an amount of 4.6% or more to obtain these effects. With a Ni content of more than 8.0%, the martensitic phase becomes less stable, and the strength decreases. For this reason, the Ni content is limited to 4.6 to 8.0%. The Ni content is preferably 4.6 to 7.6%, more preferably 4.6 to 6.8%.

Cr: 10.0 to 14.0%

Cr is an element that forms a protective coating, and improves the corrosion resistance. The required corrosion resistance for oil country tubular goods can be provided when Cr is contained in an amount of 10.0% or more. A Cr content of more than 14.0% facilitates ferrite formation, and a stable martensitic phase cannot be provided. For this reason, the Cr content is limited to 10.0 to 14.0%. The Cr content is preferably 11.0% or more, more preferably 11.2% or more. The Cr content is preferably 13.5% or less.

Mo: 1.0 to 2.7%

Mo is an element that improves the resistance against pitting corrosion by $Cl^-$. Mo needs to be contained in an amount of 1.0% or more to obtain the corrosion resistance necessary for a severe corrosive environment. Mo is also an expensive element, and a Mo content of more than 2.7% increases the manufacturing cost. A Mo content of more than 2.7% also produces areas of higher Mo concentrations in the passive film, which promote breaking of the passive film, and impair the sulfide stress corrosion cracking resistance. For this reason, the Mo content is limited to 1.0 to 2.7%. The Mo content is preferably 1.2% or more, more preferably 1.5% or more. The Mo content is preferably 2.6% or less, more preferably 2.5% or less.

Al: 0.1% or Less

Al acts as a deoxidizing agent, and an Al content of 0.01% or more is preferred for obtaining this effect. However, Al has an adverse effect on toughness when contained in an amount of more than 0.1%. For this reason, the Al content is limited to 0.1% or less in the disclosed embodiments. The Al content is preferably 0.01% or more, and is preferably 0.03% or less.

V: 0.005 to 0.2%

V needs to be contained in an amount of 0.005% or more to improve steel strength through precipitation hardening, and to improve sulfide stress corrosion cracking resistance. Because a V content of more than 0.2% impairs toughness, the V content is limited to 0.005 to 0.2% in the disclosed embodiments. The V content is preferably 0.008% or more, and is preferably 0.18% or less.

N: 0.1% or Less

N is an element that acts to increase strength by forming a solid solution in the steel, in addition to improving pitting corrosion resistance. However, N forms various nitride inclusions, and impairs pitting corrosion resistance when contained in an amount of more than 0.1%. For this reason, the N content is limited to 0.1% or less in the disclosed embodiments. Preferably, the N content is 0.010% or less.

Ti: 0.06 to 0.25%

When contained in an amount of 0.06% or more, Ti reduces the solid-solution carbon by forming carbides, and improves the sulfide stress corrosion cracking resistance by reducing hardness. However, when contained in an amount of more than 0.25%, Ti generates TiN in the form of an inclusion, which potentially becomes an initiation point of pitting corrosion, and impairs the sulfide stress corrosion cracking resistance. For this reason, the Ti content is limited to 0.06 to 0.25%. The Ti content is preferably 0.08% or more. The Ti content is preferably 0.15% or less.

Cu: 0.01 to 1.0%

Cu is contained in an amount of 0.01% or more to strengthen the protective coating, and improve the sulfide stress corrosion cracking resistance. However, when contained in an amount of more than 1.0%, Cu precipitates into CuS, and impairs hot workability. Because Cu is an austenite forming element, Cu, when contained in an amount of more than 1.0%, increases the amount of retained austenite, and impairs the sulfide stress corrosion cracking resistance as a result of increased hardness. For this reason, the Cu content is limited to 0.01 to 1.0%. The Cu content is preferably 0.01 to 0.8%, more preferably 0.01 to 0.5%.

Co: 0.01 to 1.0%

Co is an element that improves the pitting corrosion resistance, in addition to reducing hardness by raising the Ms point and promoting α transformation. Co needs to be contained in an amount of 0.01% or more to obtain these effects. However, an excessively high Co content may impair toughness, and increases the material cost. When contained in an amount of more than 1.0%, Co increases the amount of retained austenite, and impairs the sulfide stress corrosion cracking resistance as a result of increased hardness. For this reason, the Co content is limited to 0.01 to 1.0% in the disclosed embodiments. The Co content is preferably 0.03% or more, and is preferably 0.6% or less.

In the disclosed embodiments, C, Mn, Cr, Cu, Ni, Mo, N, and Ti are contained in the foregoing amounts, and these elements, with optionally contained W and Nb, are contained in such amounts that the values of the following formulae (1), (2), and (3) satisfy the formula (4) below.

$$-109.37C+7.307Mn+6.399Cr+6.329Cu+11.343Ni-13.529Mo+1.276W+2.925Nb+196.775N-2.621Ti-120.307 \quad \text{Formula (1)}$$

$$-0.0278Mn+0.0892Cr+0.00567Ni+0.153Mo-0.0219W-1.984N+0.208Ti-1.83 \quad \text{Formula (2)}$$

$$-1.324C+0.0533Mn+0.0268Cr+0.0893Cu+0.00526Ni+0.0222Mo-0.0132W-0.473N-0.5Ti-0.514 \quad \text{Formula (3)}$$

$$-35.0 \leq \text{value of (1)} \leq 545.0,\ -0.600 \leq \text{value of (2)} \leq -0.250,\ \text{and}\ -0.400 \leq \text{value of (3)} \leq 0.010 \quad \text{Formula (4)}$$

In the formulae, C, Mn, Cr, Cu, Ni, Mo, W, Nb, N, and Ti represent the content of each element in mass % (the content is 0 (zero) percent for elements that are not contained).

Formula (1) correlates with an amount of retained austenite (retained γ). By reducing the value of (1), the retained austenite decreases, and the sulfide stress corrosion cracking resistance improves as a result of decreased hardness.

Formula (2) correlates with repassivation potential. A passive film regenerates more easily, and repassivation improves when C, Mn, Cr, Cu, Ni, Mo, N, and Ti (and, optionally, W and Nb) are contained in such amounts that the value of formula (1) satisfies the range of formula (4), and when Mn, Cr, Ni, Mo, N, and Ti (and, optionally, W) are contained in such amounts that the value of formula (2) satisfies the range of formula (4).

Formula (3) correlates with pitting corrosion potential. It is possible to reduce generation of pitting corrosion, which becomes an initiation point of sulfide stress corrosion cracking, and to greatly improve sulfide stress corrosion cracking resistance when C, Mn, Cr, Cu, Ni, Mo, N, and Ti (and, optionally, W and Nb) are contained in such amounts that the value of formula (1) satisfies the range of formula (4), and when C, Mn, Cr, Cu, Ni, Mo, N, and Ti (and, optionally, W) are contained in such amounts that the value of formula (3) satisfies the range of formula (4).

It should be noted here that, with the value of (1) satisfying the range of formula (4), the hardness increases when the value of (1) is 10 or more. However, with the value of (2) and the value of (3) satisfying the ranges of formula (4), it is possible to achieve notable regeneration of passive film, and great reduction of pitting corrosion, with the result that the sulfide stress corrosion cracking resistance improves.

Preferably, the value of (1) is −30.0 or more. The value of (1) is preferably 45.0 or less, more preferably 40.0 or less.

The value of (2) is preferably −0.550 or more, more preferably −0.530 or more. Preferably, the value of (2) is −0.255 or less.

The value of (3) is preferably −0.350 or more, more preferably −0.320 or more. Preferably, the value of (3) is 0.008 or less.

C and Ti are contained so as to satisfy the following formula (5) or (6).

$$Ti<6.0C \quad \text{Formula (5)}$$

$$10.1C<Ti \quad \text{Formula (6)}$$

In the formulae, C and Ti represent the content of each element in mass % (the content is 0 (zero) percent for elements that are not contained).

C and Ti are elements involved in hardness. It is possible to decrease hardness by containing Ti. However, when contained, Ti forms Ti-base inclusions, and impairs the sulfide stress corrosion cracking resistance. The hardness decreases with reduced C contents. However, it becomes difficult to obtain the desired strength. By containing C and Ti so as to satisfy the formula (5) or (6), the impairment of sulfide stress corrosion cracking resistance due to inclusions, and the detrimental effect of inclusions on strength can be minimized, and the sulfide stress corrosion cracking resistance improves as a result of decreased hardness. In formula (5), Ti is preferably more than 4.4C. In formula (6), Ti is preferably less than 20.0C.

The balance is Fe and incidental impurities in the composition.

In addition to these basic components, the composition may further contain at least one optional element selected from Nb: 0.1% or less, and W: 1.0% or less, as needed. Nb forms carbides, and can reduce hardness by reducing solid-solution carbon. However, Nb may impair toughness when contained in excessively large amounts. W is an element that improves the pitting corrosion resistance. However, W may impair toughness, and increases the material cost when contained in excessively large amounts. For this reason, Nb, when contained, is contained in a limited amount of 0.1% or less, and W, when contained, is contained in a limited amount of 1.0% or less.

One or more selected from Ca: 0.010% or less, REM: 0.010% or less, Mg: 0.010% or less, and B: 0.010% or less may be contained as optional elements, as needed. Ca, REM, Mg, and B are elements that improve the corrosion resistance by controlling the shape of inclusions. The desired contents for providing this effect are Ca: 0.0005% or more, REM: 0.0005% or more, Mg: 0.0005% or more, and B: 0.0005% or more. Ca, REM, Mg, and B impair toughness and carbon dioxide corrosion resistance when contained in amounts of more than Ca: 0.010%, REM: 0.010%, Mg: 0.010%, and B: 0.010%. For this reason, the contents of Ca, REM, Mg, and B, when contained, are limited to Ca: 0.010% or less, REM: 0.010% or less, Mg: 0.010% or less, and B: 0.010% or less.

In the disclosed embodiments, aside from the dominant-phase martensite, the microstructure may include delta ferrite and retained austenite, though the microstructure is not particularly limited. Preferably, delta ferrite should be reduced as much as possible because delta ferrite causes cracking or defect during pipe manufacture. Retained austenite leads to increased hardness, and is contained in an amount of preferably 0.0 to 10.5% by volume.

The following describes a preferred method for manufacturing a stainless steel seamless pipe for oil country tubular goods of the present application.

In the present application, a steel pipe material of the foregoing composition is used. However, the method of production of a stainless steel seamless pipe used as a steel pipe material is not particularly limited, and any known seamless pipe manufacturing method may be used.

Preferably, a molten steel of the foregoing composition is made into steel using a smelting process such as by using a converter, and formed into a steel pipe material, for example, a billet, using a method such as continuous casting, or ingot casting-blooming. The steel pipe material is then heated, and hot worked into a pipe using a known pipe manufacturing process, for example, the Mannesmann-plug mill process or the Mannesmann-mandrel mill process to produce a seamless steel pipe of the foregoing composition.

The process after the production of the steel pipe from the steel pipe material is not particularly limited. Preferably, the steel pipe is subjected to quenching in which the steel pipe is heated to a temperature equal to or greater than the $Ac_3$ transformation point, and cooled to a cooling stop temperature of 100° C. or less, followed by tempering at a temperature equal to or less than the $Ac_1$ transformation point.

Quenching

In the disclosed embodiments, the steel pipe is subjected to quenching in which the steel pipe is reheated to a temperature equal to or greater than the $Ac_3$ transformation point, held for preferably at least 5 min, and cooled to a cooling stop temperature of 100° C. or less. This makes it possible to produce a refined, tough martensitic phase. When the heating temperature of quenching is less than the $Ac_3$ transformation point, the microstructure cannot be heated into the austenite single-phase region, and a sufficient martensitic microstructure does not occur in the subsequent cooling, with the result that the desired high strength cannot be obtained. For this reason, the quenching heating temperature is limited to a temperature equal to or greater than the $Ac_3$ transformation point. The cooling method is not particularly limited. Typically, the steel pipe is air cooled (at a cooling rate of 0.05° C./s or more and 20° C./s or less) or water cooled (at a cooling rate of 5° C./s or more and 100° C./s or less). The cooling rate conditions are not limited either.

Tempering

The quenched steel pipe is tempered. The tempering is a process in which the steel pipe is heated to a temperature equal to or less than the $Ac_1$ transformation point, held for preferably at least 10 min, and air cooled. When the tempering temperature is higher than the $Ac_1$ transformation point, the martensitic phase precipitates after the tempering, and it is not possible to provide the desired high toughness and excellent corrosion resistance. For this reason, the tempering temperature is limited to a temperature equal to or less than the $Ac_1$ transformation point. The $Ac_3$ transformation point (° C.) and $Ac_1$ transformation point (° C.) can be measured by a Formaster test by giving a heating and cooling temperature history to a test piece, and finding the transformation point from a microdisplacement due to expansion and contraction.

EXAMPLES

The disclosed embodiments are further described below through Examples.

Molten steels containing the components shown in Table 1 were made into steel with a converter, and cast into billets (steel pipe material) by continuous casting. The billet was hot worked into a pipe with a model seamless rolling mill, and cooled by air cooling or water cooling to produce a seamless steel pipe measuring 83.8 mm in outer diameter and 12.7 mm in wall thickness.

The formulae (1), (2), and (3) presented in Table 1 are as follows. The table shows whether the values of these formulae satisfy the formula (4) below.

The formulae (5) and (6) presented in Table 1 are as follows. The table shows whether the steels satisfy which of formulae (5) and (6), and a steel satisfying neither of these formulae is indicated by "out of range".

$$-109.37C+7.307Mn+6.399Cr+6.329Cu+11.343Ni-13.529Mo+1.276W+2.925Nb+196.775N-2.621Ti-120.307 \quad \text{Formula (1)}$$

$$-0.0278Mn+0.0892Cr+0.00567Ni+0.153Mo-0.0219W-1.984N+0.208Ti-1.83 \quad \text{Formula (2)}$$

$$-1.324C+0.0533Mn+0.0268Cr+0.0893Cu+0.00526Ni+0.0222Mo-0.0132W-0.473N-0.5Ti-0.514 \quad \text{Formula (3)}$$

$$-35.0 \leq \text{value of (1)} \leq 45.0,\ -0.600 \leq \text{value of (2)} \leq -0.250,\ \text{and}\ -0.400 \leq \text{value of (3)} \leq 0.010 \quad \text{Formula (4)}$$

$$Ti < 6.0C \quad \text{Formula (5)}$$

$$10.1C < Ti \quad \text{Formula (6)}$$

In the formulae, C, Mn, Cr, Cu, Ni, Mo, W, Nb, N, and Ti represent the content of each element in mass % (the content is 0 (zero) percent for elements that are not contained).

Each seamless steel pipe was cut to obtain a test material, which was then subjected to quenching and tempering under the conditions shown in Table 2. In quenching, the steel pipes were cooled by air cooling (cooling rate: 0.5° C./s) or water cooling (cooling rate: 25° C./s).

An arc-shaped tensile test specimen specified by API standard was taken from the quenched and tempered test material, and the tensile properties (yield stress YS, tensile stress TS) were determined in a tensile test conducted according to the API specification. A test piece (4-mm diameter×10 mm) was taken from the quenched test material, and the $Ac_3$ and $Ac_1$ points (° C.) in Table 2 were measured in a Formaster test. Specifically, the test piece was heated to 500° C. at 5° C./s, and further heated to 920° C. at 0.25° C./s. The test piece was then held for 10 minutes, and cooled to room temperature at 2° C./s. The $Ac_3$ and $Ac_1$ points (° C.) were determined by detecting the expansion and contraction occurring in the test piece with this temperature history.

The SSC test was conducted according to NACE TM0177, Method A. The test environment was created by adjusting the pH of a test solution (a 0.165 mass % NaCl aqueous solution; liquid temperature: 25° C.; $H_2S$: 1 bar; $CO_2$ bal.) to 3.5 with the addition of sodium acetate and hydrochloric acid. In the test, a stress 90% of the yield stress was applied for 720 hours in the solution. Samples were determined as being acceptable when there was no crack in the test piece after the test, and unacceptable when the test piece had a crack after the test.

The results are presented in Table 2.

TABLE 1

| Steel | Composition (mass %) | | | | | | | | | | | |
|---|---|---|---|---|---|---|---|---|---|---|---|---|
| No. | C | Si | Mn | P | S | Ni | Cr | Mo | Al | V | N | Ti |
| A | 0.0108 | 0.18 | 0.31 | 0.014 | 0.001 | 5.84 | 11.9 | 1.88 | 0.027 | 0.046 | 0.0041 | 0.062 |
| B | 0.0106 | 0.20 | 0.28 | 0.015 | 0.001 | 5.90 | 12.0 | 1.91 | 0.040 | 0.044 | 0.0052 | 0.060 |
| C | 0.0112 | 0.19 | 0.35 | 0.017 | 0.001 | 6.03 | 12.4 | 2.20 | 0.042 | 0.014 | 0.0065 | 0.114 |
| D | 0.0116 | 0.20 | 0.29 | 0.015 | 0.001 | 5.85 | 11.9 | 2.02 | 0.032 | 0.038 | 0.0070 | 0.069 |
| E | 0.0134 | 0.18 | 0.47 | 0.016 | 0.001 | 7.56 | 13.8 | 1.21 | 0.038 | 0.020 | 0.0064 | 0.152 |
| F | 0.0155 | 0.17 | 0.27 | 0.014 | 0.001 | 4.81 | 11.2 | 2.59 | 0.039 | 0.024 | 0.0087 | 0.209 |
| G | 0.0133 | 0.20 | 0.26 | 0.015 | 0.001 | 7.23 | 13.0 | 2.33 | 0.032 | 0.051 | 0.0048 | 0.171 |
| H | 0.0124 | 0.19 | 0.48 | 0.015 | 0.001 | 6.64 | 11.8 | 1.31 | 0.042 | 0.044 | 0.0041 | 0.070 |
| I | 0.0108 | 0.18 | 0.49 | 0.013 | 0.001 | 5.99 | 13.9 | 2.03 | 0.039 | 0.044 | 0.0055 | 0.062 |
| J | 0.0133 | 0.19 | 0.26 | 0.014 | 0.001 | 5.46 | 11.0 | 1.74 | 0.044 | 0.037 | 0.0079 | 0.245 |
| K | 0.0094 | 0.21 | 0.43 | 0.015 | 0.001 | 5.21 | 11.6 | 1.94 | 0.029 | 0.015 | 0.0103 | 0.117 |
| L | 0.0134 | 0.17 | 0.23 | 0.013 | 0.001 | 6.72 | 12.0 | 1.64 | 0.045 | 0.025 | 0.0143 | 0.210 |
| M | 0.0146 | 0.18 | 0.39 | 0.014 | 0.001 | 4.52 | 13.8 | 1.36 | 0.037 | 0.045 | 0.0063 | 0.076 |
| N | 0.0105 | 0.19 | 0.44 | 0.015 | 0.001 | 6.37 | 12.3 | 2.81 | 0.038 | 0.017 | 0.0074 | 0.148 |
| O | 0.0151 | 0.20 | 0.29 | 0.014 | 0.001 | 5.29 | 12.8 | 1.65 | 0.041 | 0.033 | 0.0043 | 0.054 |
| P | 0.0119 | 0.18 | 0.40 | 0.016 | 0.001 | 5.63 | 11.7 | 1.93 | 0.042 | 0.028 | 0.0053 | 0.128 |
| Q | 0.0108 | 0.17 | 0.47 | 0.014 | 0.001 | 6.28 | 11.5 | 2.68 | 0.039 | 0.015 | 0.0134 | 0.062 |

TABLE 1-continued

| | | | | | | | | | | | | |
|---|---|---|---|---|---|---|---|---|---|---|---|---|
| R | 0.0124 | 0.19 | 0.42 | 0.015 | 0.001 | 7.72 | 13.5 | 1.21 | 0.040 | 0.009 | 0.0156 | 0.067 |
| S | 0.0487 | 0.20 | 0.27 | 0.014 | 0.001 | 4.71 | 10.8 | 2.63 | 0.036 | 0.013 | 0.0041 | 0.211 |
| T | 0.0477 | 0.20 | 0.25 | 0.015 | 0.001 | 7.74 | 13.8 | 2.62 | 0.033 | 0.048 | 0.0048 | 0.208 |
| U | 0.0117 | 0.19 | 0.45 | 0.015 | 0.001 | 4.79 | 11.1 | 1.44 | 0.040 | 0.029 | 0.0142 | 0.065 |
| V | 0.0102 | 0.18 | 0.49 | 0.016 | 0.001 | 7.98 | 13.9 | 1.98 | 0.029 | 0.015 | 0.0039 | 0.060 |
| W | 0.0744 | 0.19 | 0.25 | 0.013 | 0.001 | 4.62 | 10.2 | 2.03 | 0.041 | 0.042 | 0.0200 | 0.250 |
| X | 0.0123 | 0.20 | 0.33 | 0.014 | 0.001 | 5.13 | 11.2 | 2.55 | 0.035 | 0.013 | 0.0069 | 0.097 |
| Y | 0.0234 | 0.18 | 0.51 | 0.014 | 0.001 | 5.14 | 11.7 | 2.45 | 0.046 | 0.037 | 0.0165 | 0.128 |
| Z | 0.0114 | 0.20 | 0.35 | 0.015 | 0.001 | 8.06 | 12.4 | 1.56 | 0.040 | 0.021 | 0.0079 | 0.065 |
| AA | 0.0331 | 0.17 | 0.34 | 0.016 | 0.001 | 6.54 | 13.1 | 2.31 | 0.037 | 0.004 | 0.0210 | 0.140 |
| AB | 0.0157 | 0.19 | 0.42 | 0.015 | 0.001 | 6.33 | 12.2 | 2.62 | 0.044 | 0.064 | 0.0097 | 0.190 |

| Steel No. | Composition (mass %) Cu | Co | Nb, W | Ca, REM, Mg, B | Value of formula (1) (*1) | Value of formula (2) (*2) | Value of formula (3) (*3) | Ti/C | Formula (5) or (6) (*4) | Remarks |
|---|---|---|---|---|---|---|---|---|---|---|
| A | 0.16 | 0.27 | — | — | −0.6 | −0.452 | −0.139 | 5.7 | (5) | Compliant Example |
| B | 0.21 | 0.23 | — | — | 0.6 | −0.440 | −0.132 | 5.7 | (5) | Compliant Example |
| C | 0.07 | 0.09 | — | — | 0.4 | −0.352 | −0.151 | 10.2 | (6) | Compliant Example |
| D | 0.15 | 0.16 | — | B: 0.002 | −2.1 | −0.434 | −0.144 | 5.9 | (5) | Compliant Example |
| E | 0.50 | 0.41 | W: 0.11 | — | 43.5 | −0.368 | −0.106 | 11.3 | (6) | Compliant Example |
| F | 0.09 | 0.08 | — | Ca: 0.003 | −27.1 | −0.389 | −0.238 | 13.5 | (6) | Compliant Example |
| G | 0.31 | 0.32 | — | Ca: 0.002, REM: 0.002 | 16.3 | −0.254 | −0.140 | 12.9 | (6) | Compliant Example |
| H | 0.42 | 0.24 | Nb: 0.04 | — | 18.3 | −0.546 | −0.124 | 5.6 | (5) | Compliant Example |
| I | 0.98 | 0.14 | Nb: 0.02 | Ca: 0.002 | 18.7 | −0.257 | 0.001 | 5.7 | (5) | Compliant Example |
| J | 0.02 | 0.06 | — | Mg: 0.003 | −10.0 | −0.524 | −0.280 | 18.4 | (6) | Compliant Example |
| K | 0.34 | 0.33 | — | — | −7.2 | −0.477 | −0.155 | 12.4 | (6) | Comparative Example |
| L | 0.47 | 0.32 | — | — | 16.0 | −0.462 | −0.196 | 15.7 | (6) | Comparative Example |
| M | 0.24 | 0.41 | — | — | 4.7 | −0.373 | −0.108 | 5.2 | (5) | Comparative Example |
| N | 0.17 | 0.16 | Nb: 0.02 | — | −3.1 | −0.263 | −0.141 | 14.1 | (6) | Comparative Example |
| O | 0.51 | 0.38 | — | — | 3.7 | −0.411 | −0.095 | 3.6 | (5) | Comparative Example |
| P | 1.09 | 0.17 | Nb: 0.04 | — | 1.7 | −0.454 | −0.092 | 10.8 | (6) | Comparative Example |
| Q | 0.67 | 1.08 | — | — | −2.8 | −0.385 | 0.080 | 5.7 | (5) | Comparative Example |
| R | 0.83 | 0.31 | Nb: 0.02, W: 0.56 | — | 47.9 | −0.438 | −0.053 | 5.4 | (5) | Comparative Example |
| S | 0.05 | 0.24 | — | — | −36.1 | −0.409 | −0.294 | 4.3 | (5) | Comparative Example |
| T | 0.84 | 0.41 | — | — | 22.7 | −0.128 | −0.126 | 4.4 | (5) | Comparative Example |
| U | 0.03 | 0.15 | Nb: 0.04, W: 0.55 | — | −8.8 | −0.632 | −0.195 | 5.6 | (5) | Comparative Example |
| V | 1.00 | 0.42 | — | — | 41.8 | −0.251 | 0.015 | 5.9 | (5) | Comparative Example |
| W | 0.01 | 0.04 | W: 0.91 | — | −31.9 | −0.598 | −0.402 | 3.4 | (5) | Comparative Example |
| X | 0.57 | 0.26 | — | Ca: 0.002 | −19.2 | −0.414 | −0.130 | 7.9 | Out of range | Comparative Example |
| Y | 0.44 | 0.19 | — | — | −13.4 | −0.403 | −0.155 | 5.5 | (5) | Comparative Example |
| Z | 0.26 | 0.08 | — | — | 33.7 | −0.451 | −0.114 | 5.7 | (5) | Comparative Example |
| AA | 0.50 | 0.50 | — | — | 12.2 | −0.293 | −0.138 | 4.2 | (5) | Comparative Example |
| AB | — | 0.53 | — | — | −3.1 | −0.296 | −0.194 | 12.1 | (6) | Comparative Example |

*Underline means outside the range of the application

• The balance is Fe and incidental impurities (*1) Formula (1): −109.37 C + 7.307 Mn + 6.399 Cr + 6.329 Cu + 11.343 Ni − 13.529 Mo + 1.276 W + 2.925 Nb + 196.775 N − 2.621 Ti − 120.307

(*2) Formula (2): −0.0278 Mn + 0.0892 Cr + 0.00567 Ni + 0.153 Mo − 0.0219 W − 1.984 N + 0.208 Ti − 1.83

(*3) Formula (3): −1.324 C + 0.0533 Mn + 0.0268 Cr + 0.0893 Cu + 0.00526 Ni + 0.0222 Mo − 0.0132 W − 0.473 N − 0.5 Ti − 0.514

(*4) Formula (5): Ti < 6.0 C, Formula (6) : 10.1 C < Ti

TABLE 2

| | | Quenching | | | | | Tempering | | | Tensile properties | | SSC | |
|---|---|---|---|---|---|---|---|---|---|---|---|---|---|
| Steel pipe No. | Steel No. | $Ac_3$ point (° C.) | Heating temp. (° C.) | Holding time (min) | Cooling method | Cooling stop temp. (° C.) | $Ac_1$ point (° C.) | Heating temp. (° C.) | Holding time (min) | Yield stress YS (MPa) | Tensile stress TS (MPa) | resistance test Presence or absence of cracking | Remarks |
| 1 | A | 745 | 920 | 20 | Water cooling | 25 | 645 | 595 | 60 | 818 | 852 | Absent | Present Example |
| 2 | B | 750 | 920 | 20 | Air cooling | 25 | 650 | 605 | 60 | 787 | 846 | Absent | Present Example |
| 3 | C | 755 | 920 | 20 | Water cooling | 25 | 645 | 550 | 30 | 823 | 857 | Absent | Present Example |
| 4 | D | 745 | 920 | 20 | Air cooling | 25 | 645 | 510 | 30 | 859 | 881 | Absent | Present Example |
| 5 | E | 740 | 810 | 20 | Water cooling | 25 | 655 | 600 | 45 | 769 | 819 | Absent | Present Example |
| 6 | F | 730 | 810 | 20 | Air cooling | 25 | 640 | 560 | 45 | 826 | 869 | Absent | Present Example |
| 7 | G | 775 | 920 | 20 | Water cooling | 25 | 660 | 580 | 60 | 798 | 844 | Absent | Present Example |
| 8 | H | 750 | 920 | 20 | Water cooling | 25 | 640 | 500 | 60 | 865 | 901 | Absent | Present Example |
| 9 | I | 745 | 900 | 20 | Water cooling | 25 | 655 | 600 | 30 | 778 | 815 | Absent | Present Example |
| 10 | J | 730 | 920 | 20 | Air cooling | 25 | 640 | 585 | 60 | 800 | 839 | Absent | Present Example |
| 11 | A | 745 | 705 | 20 | Water cooling | 25 | 645 | 595 | 60 | 715 | 804 | Absent | Comparative Example |
| 12 | B | 750 | 920 | 20 | Air cooling | 25 | 650 | 680 | 60 | 688 | 780 | Absent | Comparative Example |
| 13 | K | 740 | 920 | 20 | Air cooling | 25 | 635 | 565 | 60 | 804 | 864 | Present | Comparative Example |
| 14 | L | 735 | 810 | 20 | Water cooling | 25 | 650 | 580 | 45 | 796 | 847 | Present | Comparative Example |
| 15 | M | 750 | 810 | 20 | Air cooling | 25 | 650 | 595 | 45 | 777 | 835 | Present | Comparative Example |
| 16 | N | 745 | 900 | 20 | Water cooling | 25 | 660 | 575 | 30 | 823 | 894 | Present | Comparative Example |
| 17 | O | 745 | 810 | 20 | Air cooling | 25 | 645 | 600 | 60 | 762 | 856 | Present | Comparative Example |
| 18 | P | 755 | 810 | 20 | Water cooling | 25 | 650 | 525 | 30 | 851 | 896 | Present | Comparative Example |
| 19 | Q | 760 | 920 | 20 | Water cooling | 25 | 660 | 585 | 30 | 819 | 871 | Present | Comparative Example |
| 20 | R | 760 | 920 | 20 | Air cooling | 25 | 655 | 545 | 60 | 833 | 896 | Present | Comparative Example |
| 21 | S | 740 | 810 | 20 | Air cooling | 25 | 640 | 570 | 60 | 824 | 886 | Present | Comparative Example |
| 22 | T | 765 | 920 | 20 | Water cooling | 25 | 660 | 535 | 45 | 842 | 895 | Present | Comparative Example |
| 23 | U | 750 | 920 | 20 | Water cooling | 25 | 645 | 585 | 60 | 786 | 883 | Present | Comparative Example |
| 24 | V | 750 | 920 | 20 | Air cooling | 25 | 650 | 595 | 60 | 768 | 846 | Present | Comparative Example |
| 25 | W | 745 | 920 | 20 | Air cooling | 25 | 645 | 555 | 60 | 841 | 897 | Present | Comparative Example |
| 26 | X | 735 | 900 | 20 | Water cooling | 25 | 640 | 585 | 60 | 793 | 872 | Present | Comparative Example |
| 27 | Y | 760 | 920 | 20 | Water cooling | 25 | 650 | 590 | 60 | 806 | 846 | Present | Comparative Example |
| 28 | Z | 725 | 810 | 20 | Air cooling | 25 | 635 | 600 | 60 | 747 | 809 | Absent | Comparative Example |
| 29 | AA | 750 | 900 | 20 | Air cooling | 25 | 640 | 590 | 30 | 782 | 829 | Present | Comparative Example |
| 30 | AB | 755 | 920 | 20 | Water cooling | 25 | 645 | 580 | 45 | 812 | 855 | Present | Comparative Example |

* Underline means outside the range of the application

The steel pipes of the present examples all had high strength with a yield stress of 758 MPa or more, demonstrating that the steel pipes were martensitic stainless steel seamless pipes having excellent SSC resistance that do not crack even when placed under a stress in a $H_2S$-containing environment. On the other hand, in Comparative Examples outside the range of the application, the steel pipes did not have the desired high strength or desirable SSC resistance.

The invention claimed is:

1. A martensitic stainless steel seamless pipe for oil country tubular goods, the martensitic stainless steel seamless pipe having a yield stress of 758 MPa or more and a composition comprising, in mass %, C: 0.0106% or more,
Si: 0.5% or less,
Mn: 0.25 to 0.50%,
P: 0.030% or less,
S: 0.005% or less,
Ni: 4.6 to 8.0%,
Cr: 10.0 to 14.0%,
Mo: 1.0 to 2.7%,
Al: 0.1% or less,
V: 0.005 to 0.2%,
N: 0.1% or less,
Ti: 0.06 to 0.25%,
Cu: 0.01 to 1.0%,
Co: 0.01 to 1.0%, and
a balance including Fe and incidental impurities,
the composition satisfying:

(i) all of the relations in formula (4) below, wherein value (1), value (2), and value (3) are obtained from formulae (1), (2), and (3), respectively, and (ii) formulae (5) or (6) below, $$-109.37C+7.307Mn+6.399Cr+6.329Cu+11.343Ni-13.529Mo+1.276W+2.925Nb+196.775N-2.621Ti-120.307 \quad \text{Formula (1)}$$

$$-0.0278Mn+0.0892Cr+0.00567Ni+0.153Mo-0.0219W-1.984N+0.208Ti-1.83 \quad \text{Formula (2)}$$

$$-1.324C+0.0533Mn+0.0268Cr+0.0893Cu+0.00526Ni+0.0222Mo-0.0132W-0.473N-0.5Ti-0.514 \quad \text{Formula (3)}$$

$$-35.0 \leq \text{value of (1)} \leq 45.0,\ -0.600 \leq \text{value of (2)} \leq -0.250,\ \text{and}\ -0.400 \leq \text{value of (3)} \leq 0.010 \quad \text{Formula (4)}$$

$$Ti<6.0C \quad \text{Formula (5)}$$

$$10.1C<Ti, \quad \text{Formula (6)}$$

wherein C, Mn, Cr, Cu, Ni, Mo, W, Nb, N, and Ti represent a content of each element in mass %, and the content is zero percent for element that is not present, and wherein the martensitic stainless steel seamless pipe has sulfide stress corrosion cracking resistance, and a result of an SSC test is acceptable, the SSC test: A test is conducted according to NACE TM0177, Method A, for a piece cut from the pipe, and a test environment is created by adjusting a pH of a test solution, a 0.165 mass % NaCl aqueous solution; liquid temperature: 25° C.; $H_2S$: 1 bar; $CO_2$ bal., to 3.5 with an addition of sodium acetate and hydrochloric acid, and in the test, a stress 90% of a yield stress is applied for 720 hours in the test solution, and pipes are determined as being acceptable when there is no crack in a test piece after the test, and unacceptable when the test piece has a crack after the test.

2. The martensitic stainless steel seamless pipe for oil country tubular goods according to claim 1, wherein the composition further comprises, in mass %, at least one element selected from Group (A) and/or Group (B):

Group (A):

Nb: 0.1% or less, and

W: 1.0% or less, and

Group (B):

Ca: 0.010% or less,

REM: 0.010% or less,

Mg: 0.010% or less, and

B: 0.010% or less.

3. A method for manufacturing a martensitic stainless steel seamless pipe for oil country tubular goods according to claim 1, the method comprising:

forming a steel pipe from a steel pipe material having a composition comprising, in mass %, C: 0.0106% or more, Si: 0.5% or less, Mn: 0.25 to 0.50%, P: 0.030% or less, S: 0.005% or less, Ni: 4.6 to 8.0%, Cr: 10.0 to 14.0%, Mo: 1.0 to 2.7%, Al: 0.1% or less, V: 0.005 to 0.2%, N: 0.1% or less, Ti: 0.06 to 0.25%, Cu: 0.01 to 1.0%, Co: 0.01 to 1.0%, and a balance including Fe and incidental impurities, the composition satisfying:

(i) all of the relations in formula (4) below, wherein value (1), value (2), and value (3) are obtained from formulae (1), (2), and (3), respectively, and (ii) formulae (5) or (6) below, $$-109.37C+7.307Mn+6.399Cr+6.329Cu+11.343Ni-13.529Mo+1.276W+2.925Nb+196.775N-2.621Ti-120.307 \quad \text{Formula (1)}$$

$$-0.0278Mn+0.0892Cr+0.00567Ni+0.153Mo-0.0219W-1.984N+0.208Ti-1.83 \quad \text{Formula (2)}$$

$$-1.324C+0.0533Mn+0.0268Cr+0.0893Cu+0.00526Ni+0.0222Mo-0.0132W-0.473N-0.5Ti-0.514 \quad \text{Formula (3)}$$

$$-35.0 \leq \text{value of (1)} \leq 45.0,\ -0.600 \leq \text{value of (2)} \leq -0.250, \text{ and } -0.400 \leq \text{value of (3)} \leq 0.010 \quad \text{Formula (4)}$$

$$Ti<6.0C \quad \text{Formula (5)}$$

$$10.1C<Ti, \quad \text{Formula (6)}$$

wherein C, Mn, Cr, Cu, Ni, Mo, W, Nb, N, and Ti represent a content of each element in mass %, and the content is zero percent for element that is not present;

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

4. A method for manufacturing a martensitic stainless steel seamless pipe for oil country tubular goods according to claim 2, the method comprising:

forming a steel pipe from a steel pipe material having a composition comprising, in mass %, C: 0.0106% or more, Si: 0.5% or less, Mn: 0.25 to 0.50%, P: 0.030% or less, S: 0.005% or less, Ni: 4.6 to 8.0%, Cr: 10.0 to 14.0%, Mo: 1.0 to 2.7%, Al: 0.1% or less, V: 0.005 to 0.2%, N: 0.1% or less, Ti: 0.06 to 0.25%, Cu: 0.01 to 1.0%, Co: 0.01 to 1.0%, at least one element selected from Group (A) and/or Group (B):

Group (A):

Nb: 0.1% or less, and

W: 1.0% or less, and

Group (B):

Ca: 0.010% or less,

REM: 0.010% or less,

Mg: 0.010% or less, and

B: 0.010% or less, and a balance including Fe and incidental impurities, the composition satisfying:

(i) all of the relations in formula (4) below, wherein value (1), value (2), and value (3) are obtained from formulae (1), (2), and (3), respectively, and (ii) formulae (5) or (6) below, $$-109.37C+7.307Mn+6.399Cr+6.329Cu+11.343Ni-13.529Mo+1.276W+2.925Nb+196.775N-2.621Ti-120.307 \quad \text{Formula (1)}$$

$$-0.0278Mn+0.0892Cr+0.00567Ni+0.153Mo-0.0219W-1.984N+0.208Ti-1.83 \quad \text{Formula (2)}$$

$$-1.324C+0.0533Mn+0.0268Cr+0.0893Cu+0.00526Ni+0.0222Mo-0.0132W-0.473N-0.5Ti-0.514 \quad \text{Formula (3)}$$

$$-35.0 \leq \text{value of (1)} \leq 45.0,\ -0.600 \leq \text{value of (2)} \leq -0.250, \text{ and } -0.400 \leq \text{value of (3)} \leq 0.010 \quad \text{Formula (4)}$$

$$Ti<6.0C \quad \text{Formula (5)}$$

$$10.1C<Ti, \quad \text{Formula (6)}$$

wherein C, Mn, Cr, Cu, Ni, Mo, W, Nb, N, and Ti represent a content of each element in mass %, and the content is zero percent for element that is not present;

quenching the steel pipe by heating the steel pipe to a temperature equal to or greater than an $Ac_3$ transformation point, and cooling the steel pipe to a cooling stop temperature of 100° C. or less; and tempering the steel pipe at a temperature equal to or less than an $Ac_1$ transformation point.

* * * * *